US011445319B2

(12) United States Patent
Marathe

(10) Patent No.: US 11,445,319 B2
(45) Date of Patent: Sep. 13, 2022

(54) DEVICE FOR OUTPUTTING AUDIO SIGNALS INTO THE INTERIOR OF A MOTOR VEHICLE

(71) Applicant: ASK INDUSTRIES GMBH, Niederwinkling (DE)

(72) Inventor: Srinidhi Sadashiva Marathe, Niederwinkling (DE)

(73) Assignee: ASK INDUSTRIES GMBH, Niederwinkling (DE)

( * ) Notice: Subject to any disclaimer, the term of this patent is extended or adjusted under 35 U.S.C. 154(b) by 0 days.

(21) Appl. No.: 16/495,341

(22) PCT Filed: Mar. 14, 2018

(86) PCT No.: PCT/EP2018/056405
§ 371 (c)(1),
(2) Date: Sep. 18, 2019

(87) PCT Pub. No.: WO2018/177751
PCT Pub. Date: Oct. 4, 2018

(65) Prior Publication Data

US 2020/0100043 A1 Mar. 26, 2020

(30) Foreign Application Priority Data

Mar. 28, 2017 (DE) ..... 102017106618.7

(51) Int. Cl.
*H04R 1/40* (2006.01)
*H04R 3/00* (2006.01)
(Continued)

(52) U.S. Cl.
CPC ..... *H04S 7/302* (2013.01); *H04R 3/12* (2013.01); *H04R 5/02* (2013.01); *H04R 5/04* (2013.01);
(Continued)

(58) Field of Classification Search
CPC ..... H04S 7/302; H04S 3/008; H04S 2400/01; H04R 3/12; H04R 5/02; H04R 5/04; H04R 2499/13
(Continued)

(56) References Cited

U.S. PATENT DOCUMENTS 2,288,683 A 7/1942 Clancy
2010/0014691 A1* 1/2010 Moseley ..... H03G 3/32 381/107
(Continued)

FOREIGN PATENT DOCUMENTS

DE 19931270 A1 1/2001
DE 102013001305 A1 7/2014
(Continued)

OTHER PUBLICATIONS

DE 10 2017 106 618.7 Office Action, dated Jan. 12, 2018, pp. 1-7.
PCT/EP2018/056405 International Search Report, dated May 7, 2018. pp. 1-4.

*Primary Examiner* — Nivian C Chin
*Assistant Examiner* — Douglas J Suthers
(74) *Attorney, Agent, or Firm* — Rimon P.C.

(57) ABSTRACT

Device for outputting audio signals into passenger compartment of a motor vehicle comprising: an audio output which comprises a plurality of audio output elements which can be or are arranged in an interior of a motor vehicle, a controller which is or can be assigned to the audio output and which is configured for controlling at least one output parameter of the audio signals which can be output via respective audio output elements, the controller is configured to control the at least one output parameter of respective audio output elements of the audio output on the basis of orientation information generated by a detection means which is configured for detecting the orientation and/or movement of a chassis of a motor vehicle relative to a ground, and for generating
(Continued)

Legend

| | |
|---|---|
| 1 | Device for outputting audio signals into an interior of a motor vehicle |
| 2 | Interior |
| 3 | Motor vehicle |
| 4a-4d | Output elements |
| 5 | Controller |
| 6 | Detection means |
| 7 | Chassis |

orientation information which describes a detected orientation and/or movement of the chassis of the motor vehicle relative to the ground.

13 Claims, 2 Drawing Sheets

(51) Int. Cl.

| | |
|---|---|
| ***H04S 7/00*** | (2006.01) |
| ***H04R 3/12*** | (2006.01) |
| ***H04R 5/02*** | (2006.01) |
| ***H04R 5/04*** | (2006.01) |
| ***H04S 3/00*** | (2006.01) |

(52) U.S. Cl.
CPC ..... *H04S 3/008* (2013.01); *H04R 2499/13* (2013.01); *H04S 2400/01* (2013.01)

(58) Field of Classification Search
USPC ..... 381/301, 302
See application file for complete search history.

(56) References Cited

U.S. PATENT DOCUMENTS

| | | | | |
|---|---|---|---|---|
| 2016/0016513 | A1* | 1/2016 | Di Censo ..... | H03G 3/32 340/467 |
| 2016/0157041 | A1 | 6/2016 | Shiozawa et al. | |

FOREIGN PATENT DOCUMENTS

| | | | |
|---|---|---|---|
| DE | 102013215854 | A1 | 2/2015 |
| DE | 102014218728 | A1 | 3/2016 |
| EP | 2991385 | A1 | 3/2016 |

* cited by examiner

Legend

| | |
|---|---|
| **1** | Device for outputting audio signals into an interior of a motor vehicle |
| **2** | Interior |
| **3** | Motor vehicle |
| **4a-4d** | Output elements |
| **5** | Controller |
| **6** | Detection means |
| **7** | Chassis |

U

DEVICE FOR OUTPUTTING AUDIO SIGNALS INTO THE INTERIOR OF A MOTOR VEHICLE

CROSS-REFERENCE TO RELATED APPLICATIONS

This application claims priority to Patent Cooperation Treaty application serial number PCT/EP2018/056405, filed Mar. 14, 2018, which claims priority to German patent application serial number DE 10 2017 106 618.7, filed Mar. 28, 2017, the contents of each of which are incorporated herein by reference in their entirety.

The invention relates to a device for outputting audio signals into an interior of a motor vehicle, which interior in particular forms part of a passenger compartment, said device comprising an audio output means which comprises a plurality of audio output elements which can be or are arranged in an interior of a motor vehicle, a controller which is or can be assigned to the audio output means and which is configured for controlling at least one output parameter of the audio signals which can be output via respective audio output elements.

Corresponding devices are known for example in the form of on-board audio equipment, i.e. in particular stereo or surround systems. Typical components of corresponding devices are an audio output means which comprises a plurality of audio output elements which can be or are arranged in an interior of a motor vehicle, i.e. typically loudspeakers, and a controller which is or can be assigned to the audio output means and which is configured for controlling at least one output parameter of the audio signals which can be output via respective audio output elements of the audio output means.

In view of the orientation and/or movement of the motor vehicle, i.e. in particular of the chassis, relative to a ground, which orientation and/or movement is variable in different driving situations, i.e. for example uphill travel during which the motor vehicle typically performs a pitching movement about a pitch axis at least at times, or cornering during which the motor vehicle typically performs a rolling movement about a roll axis at least at times, it is, to date, not possible to acoustically convey to vehicle occupants, i.e. in particular the driver, the corresponding orientation and/or movement of the motor vehicle. Correspondingly acoustically conveying orientations and/or movements of the motor vehicle can have a positive influence both on safety-relevant and non-safety-relevant aspects of the vehicle operation of the motor vehicle.

The object of the invention is that of specifying a device for outputting audio signals into an interior of a motor vehicle, which device is improved in particular in view of the possibility of acoustically conveying to vehicle occupants orientations and/or movements of a motor vehicle relative to a ground.

The object is achieved by a device for outputting audio signals into an interior of a motor vehicle, according to claim 1. The dependent claims relate to possible embodiments of the device.

The device described herein is used for outputting audio signals, i.e. acoustically perceptible signal information generated from audio content, into an interior, i.e. typically the passenger compartment, of a motor vehicle, and is accordingly configured for this purpose. The audio content may be for example music, text, telephone conversations, etc. The device can accordingly be configured as or form a component of on-board audio equipment, i.e. for example as a stereo or surround system.

The device comprises an audio output means which comprises a plurality of audio output elements which can be or are arranged in an interior of a motor vehicle. The audio output elements are typically arranged in the interior of the motor vehicle so as to be distributed in a specified arrangement, resulting for example from the total number of the audio output elements. Different audio output elements may be configured for outputting audio signals or audio signal components having different acoustic properties, i.e. in particular different frequencies or frequency ranges. The audio output elements are typically configured as or comprise a loudspeaker.

The audio output means can be or is assigned a controller which is implemented by means of hardware and/or software. The controller is configured for controlling at least one output parameter of the audio signals or audio signal components which can be or are output by respective audio output elements in the interior. The audio output elements can therefore be actuated by the controller individually, in groups, or altogether, and therefore the acoustic properties of the audio signals or audio signal components output by the audio output elements, which properties are defined by corresponding output parameters, can be controlled individually, in groups, or altogether. In other words, the controller is configured to control the operation of the audio output elements in view of the acoustic properties of the audio signals or audio signal components which can be or are output via the respective audio output elements.

An output parameter may for example be the energy, in particular the sound level, and/or a delay (propagation delay) of the audio signal or audio signal component which can be or is output via the respective audio output elements. An output parameter can in principle be understood as any acoustic parameter that influences, in particular in an acoustically perceptible manner, the acoustic properties of an audio signal or audio signal component output via an audio output element.

The controller is furthermore configured to control the at least one output parameter of respective audio output elements on the basis of orientation information generated by a detection means which is configured for detecting the orientation and/or movement of a chassis of a motor vehicle relative to a ground, i.e. typically the carriageway, and for generating orientation information which describes a detected orientation and/or movement of the chassis of the motor vehicle relative to the ground. The control of the relevant output parameter of the audio signals or audio signal components which can be or are output via the respective audio output elements can thus be performed on the basis of orientation information which describes a detected orientation and/or movement of the chassis of the motor vehicle relative to a ground. In this way, it is possible to acoustically convey orientations and/or movements of the motor vehicle, i.e. in particular of the chassis, relative to a ground, which orientations and/or movements vary during vehicle operation of a motor vehicle; variable orientations and/or movements of the motor vehicle can be associated with different output parameters, such that orientations and/or movements of the motor vehicle which vary during vehicle operation are acoustically perceptible for a vehicle occupant by way of correspondingly varying output parameters.

Therefore, a device for outputting audio signals into an interior of a motor vehicle, which device is improved in view of the possibility of acoustically conveying to vehicle occupants orientations and/or movements of a motor vehicle relative to a ground, is provided.

The controller typically can be or is assigned a detection means which is configured for detecting the orientation and/or movement of a chassis of a motor vehicle relative to a ground, and for generating orientation information which describes a detected orientation and/or movement of the chassis of the motor vehicle relative to the ground. The detection means can for example be configured as or comprise a sensor device which comprises at least one angular rate sensor.

The detection means can be integrated in the device or in a motor vehicle equipped with the device, and thus form a structural, i.e. in particular integral, component of the device or of a motor vehicle equipped with the device. The detection means may, however, also form a structural component of a portable electrical or electronic terminal, i.e. for example of a smartphone, tablet PC, laptop, etc., and thus not a structural component of the device or of a motor vehicle equipped with the device. In principle, any detection means can be used which is configured for generating corresponding orientation information. The orientation information therefore need not necessarily be generated on the device side, but can instead be generated "externally". Corresponding "externally" generated orientation information can be transmitted via suitable wired or wireless transmission means or interfaces, i.e. for example via radio, to a data transmission means assigned to the controller, and can be transmitted from there to the controller.

A corresponding detection means may be configured for example for detecting pitching and/or rolling and/or lifting movements of the chassis of a motor vehicle, and for generating orientation information which describes corresponding pitching and/or rolling and/or lifting movements of the chassis of the motor vehicle. Pitching movements of the chassis occurring for example during uphill travel are typically, in particular rotational, movements of the chassis about a transverse axis of the motor vehicle, in particular the vehicle transverse (center) axis (y-axis), rolling movements of the chassis occurring for example during cornering are typically, in particular rotational, movements of the chassis about a longitudinal axis of the motor vehicle, in particular the vehicle longitudinal (center) axis (x-axis), lifting movements of the chassis are typically, translational, movements of the chassis along a vertical axis (z-axis). In the case of combined pitching and/or rolling and/or lifting movements of the chassis, the detection means can optionally be configured to detect the respective pitching, rolling and lifting components separately, such that the respective pitching, rolling and lifting components are described separately in the orientation information.

As mentioned, the audio output elements are typically arranged in the interior of the motor vehicle so as to be distributed in a specified arrangement, resulting for example from the total number of the audio output elements.

The audio output means can comprise for example at least one audio output element which can be or is arranged on the driver side, and at least one audio output element which can be or is arranged on the passenger side. As a result, audio output elements can be or are arranged so as to be distributed with respect to a vehicle longitudinal (center) axis. In this case, the controller may be configured to generate control information on the basis of orientation information which describes a rolling movement of the chassis about a longitudinal axis of the motor vehicle, on the basis of which control information an audio signal is output via the at least one audio output element arranged on the driver side, which audio signal has at least one different output parameter compared with an audio signal output via the at least one audio output element arranged on the passenger side. As mentioned, rolling movements of the chassis occur for example in the event of cornering. The controller is therefore configured to make cornering or a rolling movement acoustically perceptible for a vehicle occupant by means of corresponding control of the output parameters of the audio signals or audio signal components output via the audio output elements arranged on the driver and passenger side.

For this purpose, the audio output means can be configured to output, for example on the basis of the control information generated in this case, an audio signal via the at least one audio output element which can be or is arranged on the driver side which is of a different, in particular higher or lower, energy, i.e. in particular sound level, and/or has a different, in particular higher or lower, delay, than via an audio output element which can be or is arranged on the passenger side. For example, in the case of cornering around a right-hand bend, an output of an audio signal can be controlled so as to be output more loudly or more quietly via the audio output elements arranged on the passenger side, i.e. on the inside of the bend, than via the audio output elements arranged on the driver side, i.e. on the outside of the bend. Similar applies for cornering around a left-hand bend.

Alternatively or in addition to the above-described arrangement of audio output elements on the driver and passenger side, the audio output means can comprise at least one audio output element which can be or is arranged at the front of the vehicle, and at least one audio output element which can be or is arranged at the rear of the vehicle. As a result, audio output elements can be or are arranged so as to be distributed with respect to a vehicle transverse (center) axis. In this case, the controller may be configured to generate control information on the basis of orientation information which describes a pitching movement of the chassis about a transverse axis of the motor vehicle, on the basis of which control information an audio signal is output via an audio output element which can be or is arranged at the front of the vehicle, which audio signal has at least one different output parameter compared with an audio signal output via the at least one audio output element arranged at the rear of the vehicle. As mentioned, pitching movement of the chassis occur for example in the event of uphill travel. The controller is therefore configured to make uphill travel or a pitching movement acoustically perceptible for a vehicle occupant by means of corresponding control of the output parameters of the audio signals or audio signal components output via the audio output elements arranged at the front and rear of the vehicle.

For this purpose, the audio output means can be configured to output, for example on the basis of the control information, an audio signal via the at least one audio output element which can be or is arranged at the front of the vehicle which is of a different, in particular higher or lower, energy, in particular sound level, and/or has a different, in particular higher or lower, delay, than via the at least one audio output element which can be or is arranged at the rear of the vehicle. For example, in the case of uphill travel, an output of an audio signal can be controlled so as to be output more loudly or more quietly via the audio output elements arranged at the rear of the vehicle than via the audio output elements arranged at the front of the vehicle. Similar applies for downhill travel.

In the event of lifting movements of the chassis along a vertical axis of the motor vehicle, the controller may be configured to generate control information on the basis of orientation information which describes a lifting movement, on the basis of which control information an audio signal is output via at least one first audio output element which audio signal has at least one different output parameter compared with an audio signal output via the at least one second audio output element. Provided that the two audio output elements are arranged differently, the first and second audio output element may for example be an audio output element arranged (more) on the driver side or (more) on the passenger side, and (more) at the front of the vehicle or (more) at the rear of the vehicle. In principle, first audio output elements can for example be arranged so as to be (more) on the vehicle floor side and second audio output elements can for example be arranged so as to be (more) on the vehicle ceiling side. As a result, audio output elements can be or are arranged so as to be distributed with respect to a horizontal vehicle plane. Analogously to the rolling and pitching movements of the chassis already described, the controller can therefore be configured to make a lifting movement acoustically perceptible for a vehicle occupant by means of corresponding control of the output parameters of the audio signals or audio signal components output via the differently arranged first and second audio output elements, or first and second audio signal component groups.

For this purpose, the audio output means can be configured to output, on the basis of the control information, an audio signal via at least one first audio output element which is of a different, in particular higher or lower, energy, in particular sound level, and/or has a different, in particular higher or lower, delay, than via at least one second audio output element. For example, in the case of a positive lifting movement (lifting movement upwards), an output of an audio signal can be controlled so as to be output more loudly or more quietly via the audio output elements arranged on the vehicle floor side than via the audio output elements arranged on the vehicle ceiling side. Similar applies for a negative lifting movement (lifting movement downwards).

The controller may be configured to carry out a change of the at least one output parameter, which change takes place within the context of controlling the at least one output parameter on the basis of the orientation information generated by the detection means, in a stepless manner. In this way, a change of an output parameter does not appear sudden to a vehicle occupant, which could be perceived to be disruptive.

The controller may be configured to perform a control, in particular adjustment, of at least one output parameter, in particular with respect to a reference output parameter, which control or adjustment is performed on the basis of orientation information, within a specifiable or specified boundary value range. It is thus possible to ensure that the output, which can be or is controlled as described, of an audio signal, is not perceived as disruptive by a vehicle occupant, for example due to being suddenly too loud on the driver side.

It is of course possible for the control of the at least one output parameter of respective audio output elements to be performed not only on the basis of an orientation or movement of the chassis relative to a ground, but instead additionally taking account of further operating or driving parameters of the motor vehicle, i.e. for example a (positive and negative) acceleration, speed, etc.

The invention also relates to a motor vehicle. The motor vehicle, which is for example a passenger car, comprises a device as described for outputting audio signals into an interior of the motor vehicle, which interior in particular forms a part of a passenger compartment. Therefore, all the explanations in connection with the device apply analogously for the motor vehicle.

The invention furthermore relates to a method for outputting audio signals into an interior of a motor vehicle, which interior in particular forms part of a passenger compartment, by means of an audio output means which comprises a plurality of audio output elements which can be or are arranged in an interior of a motor vehicle. The method comprises the following steps: detecting the orientation and/or movement of a chassis of a motor vehicle relative to a ground, generating orientation information which describes a detected orientation and/or movement of the chassis of the motor vehicle relative to the ground, and controlling at least one output parameter of respective audio output elements of the audio output means on the basis of orientation information generated by the detection means. The method can in particular be performed using a device as described. Therefore, all the explanations in connection with the device apply analogously for the method.

Further advantages and details of the invention can be found the embodiments described in the following and on the basis of the drawings, in which.

Figure 1:
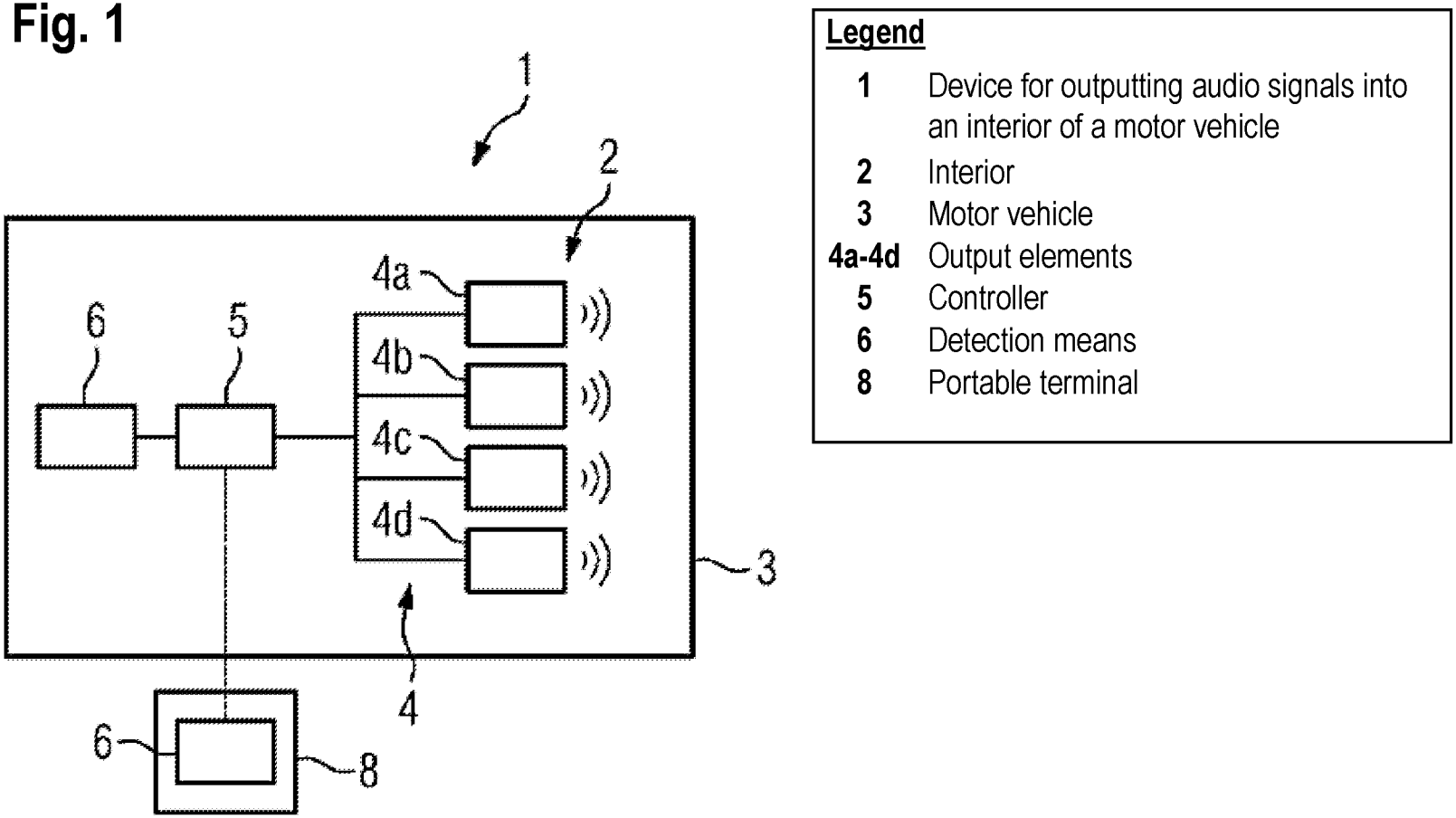
FIG. 1 is a schematic view of a device according to an embodiment.

FIG. 1 is a schematic view of a device 1 according to an embodiment. The device 1 is used for outputting audio signals, i.e. acoustically perceptible signal information generated from audio content, in an interior 2, i.e. typically the passenger compartment, of a motor vehicle 3, and is accordingly configured for this purpose. The device 1 can be configured as on-board audio equipment, i.e. for example as a stereo or surround system.

The device 1 comprises an audio output means 4 which comprises a plurality of audio output elements 4*a*-4*d* which are arranged in an interior 2 of a motor vehicle 3. The audio output elements 4*a*-4*d* which are configured as or comprise loudspeaker elements are arranged in the interior 2 of the motor vehicle 3 so as to be distributed in a specified arrangement. In the embodiments shown in the figures, the two audio output elements 4*a*, 4*b* are arranged, by way of example, in the interior 2 at the front of the vehicle, wherein the audio output element 4*a* is arranged, by way of example, on the driver side, and the audio output element 4*b* is arranged, by way of example, on the passenger side, and the audio output elements 4*c*, 4*d* are arranged, by way of example, in the interior 2 at the rear of the vehicle, audio output elements 4*a*, 4*b* are arranged in the interior 2 at the front of the vehicle, wherein the audio output element 4*c* is arranged, by way of example, on the driver side, and the audio output element 4*d* is arranged, by way of example, on the passenger side.

The audio output means 4 is assigned a controller 5 which is implemented by means of hardware and/or software. The controller 5 is configured for controlling at least one output parameter of the audio signals or audio signal components which can be or are output by respective audio output elements 4*a*-4*d* in the interior 2. The audio output elements 4*a*-4*d* can therefore be actuated by the controller 5 individually, in groups, or altogether, and therefore the acoustic properties of the audio signals or audio signal components output by the audio output elements 4*a*-4*d*, which properties are defined by corresponding output parameters, can be controlled individually, in groups, or altogether.

An output parameter may for example be the energy, in particular the sound level, and/or a delay (propagation delay) of the audio signal or audio signal component output via the respective audio output elements 4*a*-4*d*.

Figure 2:
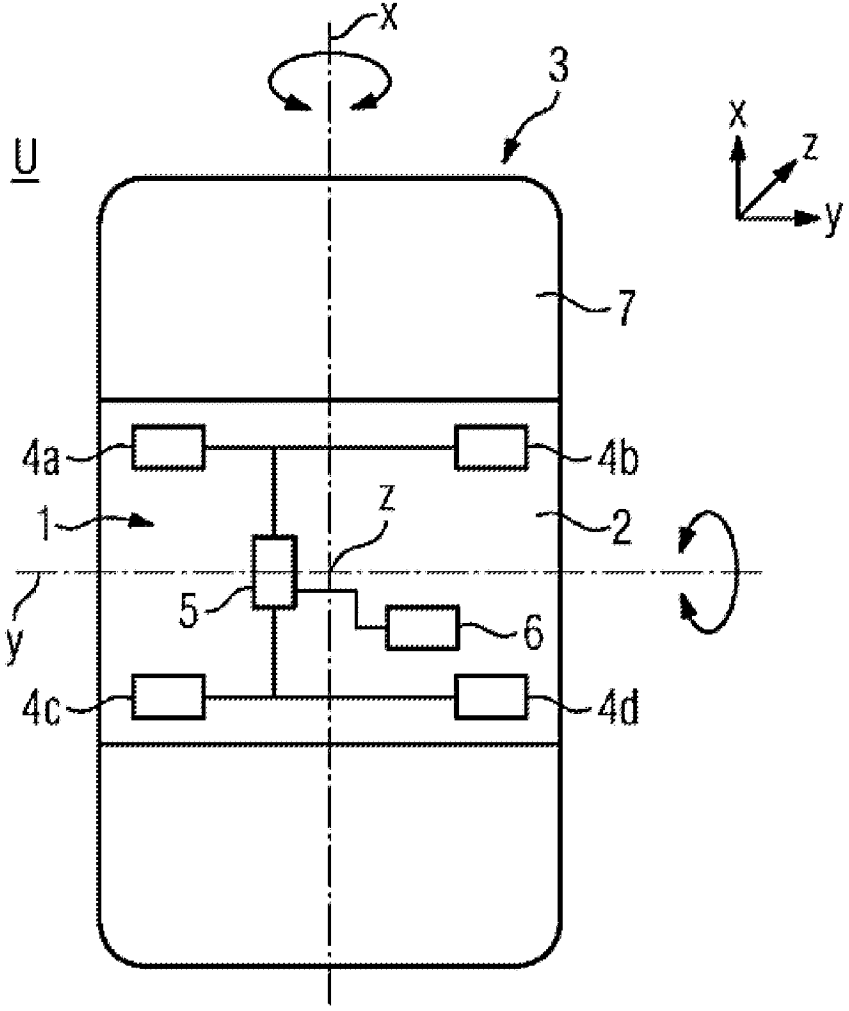
FIG. 2 is a schematic plan view of a motor vehicle according to an embodiment.

The controller 5 is configured to control a relevant output parameter of respective audio output elements 4*a*-4*d* on the basis of orientation information generated by a detection means 6 which is configured for detecting the orientation and/or movement of a chassis 7 of a motor vehicle 3 (cf. FIG. 2) relative to a ground U, i.e. typically a carriageway, and for generating orientation information which describes a detected orientation and/or movement of the chassis 7 of the motor vehicle 3 relative to the ground U. The control of the relevant output parameter of the audio signals or audio signal components output via the respective audio output elements 4*a*-4*d* can thus be performed on the basis of orientation information which describes a detected orientation and/or movement of the chassis 7 of the motor vehicle 3 relative to a ground U. In this way, it is possible to acoustically convey orientations and/or movements of the chassis 7 of the motor vehicle 3, relative to the ground U, which orientations and/or movements vary during vehicle operation of the motor vehicle 3; variable orientations and/or movements of the chassis 7 or of the motor vehicle 3 can be associated with different output parameters, such that orientations and/or movements of the chassis 7 or of the motor vehicle 3 which vary during vehicle operation are acoustically perceptible for a vehicle occupant by way of correspondingly varying output parameters.

The controller 5 can be or is assigned a detection means 6 which is configured for detecting the orientation and/or movement of the chassis 7 of the motor vehicle 3 relative to the ground U, and for generating orientation information which describes a detected orientation and/or movement of the chassis 7 of the motor vehicle 3 relative to the ground U. The detection means 6 can be configured as or comprise a sensor device (not shown) which comprises at least one angular rate sensor.

It can be seen from FIG. 1 that the detection means 6 can be integrated in the device 1 or in the motor vehicle 3 equipped with the device 1, and thus form a structural, i.e. in particular integral, component of the device 1 or of the motor vehicle 3. However, FIG. 1 also shows the alternative or additional option of the detection means 6 or a further detection means 6 forming a structural component of a portable electrical or electronic terminal 8, i.e. for example of a smartphone, tablet PC, laptop, etc., and thus not a structural component of the device 1 or of a motor vehicle 3.

The detection means 6 is in particular configured for detecting pitching and/or rolling and/or lifting movements of the chassis 7 of the motor vehicle 3, and for generating orientation information which describes corresponding pitching and/or rolling and/or lifting movements of the chassis 7 of the motor vehicle 3. Pitching movements of the chassis 7 are, in particular rotational, movements of the chassis 7 about a transverse axis (y-axis) of the motor vehicle 3, in particular the vehicle transverse (center) axis, rolling movements of the chassis 7 are, in particular rotational, movements of the chassis 7 about a longitudinal axis (x-axis) of the motor vehicle 3, in particular the vehicle longitudinal (center) axis, lifting movements of the chassis 7 are, translational, movements of the chassis 7 along a vertical axis (z-axis). In the case of combined pitching and/or rolling and/or lifting movements of the chassis 7, the detection means 6 may be configured to detect the respective pitching, rolling and lifting components separately, such that the respective pitching, rolling and lifting components are described separately in the orientation information.

The controller 5 is configured to generate control information on the basis of orientation information which describes a rolling movement of the chassis 7 about a longitudinal axis (x-axis) of the motor vehicle 3, on the basis of which control information an audio signal is output via the audio output element(s) 4*a*, 4*c* arranged on the driver side, which audio signal has at least one different output parameter compared with an audio signal output via the audio output element(s) 4*b*, 4*d* arranged on the passenger side. Rolling movements of the chassis 7 occur for example in the event of cornering. The controller 5 is therefore configured to make cornering or a rolling movement acoustically perceptible for a vehicle occupant by means of corresponding control of the output parameters of the audio signals or audio signal components output via the audio output elements 4*a*-4*d* arranged on the driver and passenger side.

For this purpose, the audio output means 4 is configured to output, on the basis of the control information generated in this case, the audio signal via the audio output element(s) 4*a*, 4*c* arranged on the driver side which is of a different, in particular higher or lower, energy, i.e. in particular sound level, and/or has a different, in particular higher or lower, delay, than via the audio output element(s) 4*b*, 4*d* arranged on the passenger side. For example, in the case of cornering around a right-hand bend, an output of an audio signal can be controlled so as to be output more loudly or more quietly via the audio output elements 4*b*, 4*d* arranged on the passenger side, i.e. on the inside of the bend, than via the audio output elements 4*a*, 4*c* arranged on the driver side, i.e. on the outside of the bend. Similar applies for cornering around a left-hand bend.

The controller 5 is configured to generate control information on the basis of orientation information which describes a pitching movement of the chassis 7 about a transverse axis (y-axis) of the motor vehicle 3, on the basis of which control information an audio signal is output via the audio output element(s) 4*a*, 4*b* arranged at the front of the vehicle, which audio signal has at least one different output parameter compared with an audio signal output via the audio output element(s) 4*c*, 4*d* arranged at the rear of the vehicle. Pitching movement of the chassis 7 occur for example in the event of uphill travel. The controller 5 is therefore configured to make uphill travel or a pitching movement acoustically perceptible for a vehicle occupant by means of corresponding control of the output parameters of the audio signals or audio signal components output via the audio output elements 4*a*-4*d* arranged at the front and rear of the vehicle.

For this purpose, the audio output means 4 is configured to output, on the basis of the control information, an audio signal via the audio output element(s) 4*a*, 4*b* arranged at the front of the vehicle which is of a different, in particular higher or lower, energy, in particular sound level, and/or has a different, in particular higher or lower, delay, than via the audio output element(s) 4*c*, 4*d* arranged at the rear of the vehicle. For example, in the case of uphill travel, an output of an audio signal can be controlled so as to be output more loudly or more quietly via the audio output elements 4*c*, 4*d* arranged at the rear of the vehicle than via the audio output elements 4*c*, 4*d* arranged at the front of the vehicle. Similar applies for downhill travel.

In the event of lifting movements of the chassis 7 along a vertical axis (z-axis), the controller 5 is configured to generate control information on the basis of orientation information which describes a lifting movement, on the basis of which control information an audio signal is output via at least one first audio output element 4*a*-4*d*, which audio signal has at least one different output parameter compared with an audio signal output via at least one second audio output element 4*a*-4*d*. Provided that the two audio output elements 4*a*-4*d* are arranged differently, the first and second audio output element 4*a*-4*d* may for example be an audio output element 4*a*-4*d* arranged (more) on the driver side or (more) on the passenger side, and (more) at the front of the vehicle or (more) at the rear of the vehicle. First audio output elements 4*a*-4*d* can be arranged so as to be (more) on the vehicle floor side and second audio output elements 4*a*-4*d* can be arranged so as to be (more) on the vehicle ceiling side. Analogously to the rolling and pitching movements of the chassis 7 already described, the controller 5 can therefore be configured to make a lifting movement acoustically perceptible for a vehicle occupant by means of corresponding control of the output parameters of the audio signals or audio signal components output via the differently arranged first and second audio output elements 4*a*-4*d*.

For this purpose, the audio output means 4 is configured to output, on the basis of the control information, an audio signal via at least one first audio output element 4*a*-4*d* which is of a different, in particular higher or lower, energy, in particular sound level, and/or has a different, in particular higher or lower, delay, than via at least one second audio output element 4*a*-4*d*. For example, in the case of a positive lifting movement (lifting movement upwards), an output of an audio signal can be controlled so as to be output more loudly or more quietly via the audio output elements arranged on the vehicle floor side than via the audio output elements arranged on the vehicle ceiling side. Similar applies for a negative lifting movement (lifting movement downwards).

The controller 5 may be configured to carry out a change of the output parameter, which change takes place within the context of controlling at least one output parameter on the basis of orientation information, in a stepless manner. In this way, a change of an output parameter does not appear sudden to a vehicle occupant, which could be perceived to be disruptive.

The controller 5 may furthermore be configured to perform a control, in particular adjustment, of at least one output parameter, in particular with respect to a reference output parameter, which control or adjustment is performed on the basis of orientation information, within a specifiable or specified boundary value range. It is thus likewise possible to ensure that the output, which can be or is controlled, of an audio signal, is not perceived as disruptive by a vehicle occupant, for example due to being suddenly too loud on the driver side.

The device 1 shown in the figures makes it possible to implement a method for outputting audio signals into an interior 2 of a motor vehicle 3, which interior forms part of a passenger compartment, by means of an audio output means 4 which comprises a plurality of audio output elements 4*a*-4*d* arranged in the interior 2 of the motor vehicle 3. The method comprises the steps of: detecting the orientation and/or movement of the chassis 7 of the motor vehicle 3 relative to a ground U, generating orientation information which describes a detected orientation and/or movement of the chassis 7 of the motor vehicle 3 relative to the ground U, and controlling at least one output parameter of respective audio output elements 4*a*-4*d* of the audio output means 4 on the basis of orientation information generated by the detection means 6.

The invention claimed is:

1. A device for outputting an audio signal into an interior of a motor vehicle, which interior forms part of a passenger compartment, comprising:

an audio output means which comprises a plurality of audio output elements which can be or are arranged in the interior of the motor vehicle, and a controller which is or can be assigned to the audio output means and which is configured for controlling at least one audio output parameter of the audio signal which can be output into the interior of the motor vehicle via the audio output elements, wherein the controller is configured to control the at least one audio output parameter of the audio signal on the basis of orientation and movement information generated by a detection means which is configured for detecting an orientation and/or movement of a chassis of the motor vehicle relative to a ground on which the motor vehicle drives, to facilitate acoustically conveying orientations and movements of the chassis of the motor vehicle relative to the ground on which the motor vehicle drives, which orientations and movements vary during vehicle operation of the motor vehicle on the ground, wherein the at least one audio output parameter is an energy or a delay of the audio signal;

wherein the controller is configured to associate variable orientations and movements of the motor vehicle with different energies or delays, for controlling the at least one audio output parameter of the audio signal to be output into the interior of the motor vehicle such that orientations and movements of the motor vehicle which vary during vehicle operation of the motor vehicle on the ground are directly acoustically perceptible for a vehicle occupant by way of correspondingly varying audio output parameters;

wherein the controller is configured to carry out a change of the energy and the delay of the audio signal in a stepless manner, which stepless manner change takes place in connection with controlling the energy and the delay of the audio signal on the basis of the orientation and movement information; and wherein the controller is configured to perform a control and adjustment of the energy and the delay of the audio signal with respect to a pre-defined reference energy and delay of the audio signal on the basis of the orientation and movement information within a defined audio output parameter boundary value range.

2. A motor vehicle comprising a device according to claim 1 for outputting the audio signals into an interior of the motor vehicle, which interior in particular forms part of a passenger compartment.

3. The device according to claim 1, wherein the controller is further configured to make a lifting movement acoustically perceptible for the vehicle occupant.

4. The device according to claim 1, wherein the detection means is assigned to the controller and is configured for detecting the orientation and movement of a chassis of the motor vehicle relative to the ground on which the motor vehicle drives, and for generating the orientation and movement information which describes a detected orientation and movement of the chassis of the motor vehicle relative to the ground on which the motor vehicle drives.

5. The device according to claim 4, wherein the detection means is configured as or comprises a sensor device which comprises at least one angular rate sensor.

6. The device according to claim 4, wherein the detection means is configured for detecting pitching and/or rolling and/or lifting movements of the chassis of the motor vehicle, and for generating the orientation and movement information which describes corresponding pitching and/or rolling and/or lifting movements of the chassis of the motor vehicle relative to the ground on which the motor vehicle drives.

7. The device according to claim 6, wherein the audio output means comprises at least one audio output element which can be or is arranged on the driver side, and at least one audio output element which can be or is arranged on the passenger side, wherein the controller is configured to generate control information on the basis of orientation and movement information which describes a rolling movement of the chassis about a longitudinal axis of the motor vehicle, on the basis of which control information the audio signal is output via the at least one audio output element which can be or is arranged on the driver side, which audio signal has at least one additional and different audio output parameter of the at least one audio output parameter compared with the audio signal output via the at least one audio output element which can be or is arranged on the passenger side.

8. The device according to claim 7, wherein the audio output means is configured to output, on the basis of the control information, the audio signal via the at least one audio output element which can be or is arranged on the driver side which is of a different, in particular higher or lower, energy, in particular sound level, and/or has a different, in particular higher or lower, delay, than via an audio output element which can be or is arranged on the passenger side.

9. The device according to claim 6, wherein the audio output means comprises at least one audio output element which can be or is arranged at the front of the vehicle, and at least one audio output element which can be or is arranged at the rear of the vehicle, wherein the controller is configured to generate control information on the basis of orientation and movement information which describes a pitching movement of the chassis about a transverse axis of the motor vehicle, on the basis of which control information, the audio signal is output via an audio output element, which audio signal has at least one additional and different audio output parameter of the at least one audio output parameter compared with the audio signal output via an audio output element which can be or is arranged at the rear of the vehicle.

10. The device according to claim 9, wherein the audio output means is configured to output, on the basis of the control information, the audio signal via the at least one audio output element which can be or is arranged at the front of the vehicle which is of a different, in particular higher or lower, energy, in particular sound level, and/or has a different, in particular higher or lower, delay, than via the at least one audio output element which can be or is arranged at the rear of the vehicle.

11. The device according to claim 6, wherein the controller is configured to generate control information on the basis of orientation and movement information which describes a lifting movement of the chassis along a vertical axis of the motor vehicle, on the basis of which control information the audio signal is output via at least one first audio output element, which audio signal has at least one additional and different audio output parameter of the at least one audio output parameter compared with the audio signal output via at least one second audio output element.

12. The device according to claim 11, wherein the audio output means is configured to output, on the basis of the control information, the audio signal via at least one first audio output element which is of a different, in particular higher or lower, energy, in particular sound level, and/or has a different, in particular higher or lower, delay, than via at least one second audio output element.

13. A method for outputting an audio signal into an interior of a motor vehicle, which interior in particular forms part of a passenger compartment, by means of an audio output means which comprises a plurality of audio output elements which can be or are arranged in the interior of the motor vehicle, in particular by means of a device according to claim 1, said method comprising the following steps:

detecting, via a detection means, an orientation and/or movement of a chassis of the motor vehicle relative to a ground on which the motor vehicle drives, generating orientation and movement information which describes the detected orientation and/or movement of the chassis of the motor vehicle relative to the ground on which the motor vehicle drives, and controlling at least one audio output parameter of respective audio output elements of the audio output means on the basis of the orientation and movement information;

whereby specific orientations and movements of the motor vehicle are assigned to defined variations of specific audio output parameters of the at least one audio output parameter, such that different orientations and/or movements of the motor vehicle which vary during vehicle operation of the motor vehicle on the ground are differently acoustically perceptible for a vehicle occupant by way of correspondingly varying the specific audio output parameters;

wherein a control or adjustment of the at least one audio output parameter is performed via a controller with respect to a pre-defined reference audio output parameter on the basis of the orientation and movement information within a defined audio output parameter boundary value range;

wherein the at least one audio output parameter is an energy of the audio signal and the controller is configured to carry out a change of the energy and a delay of the audio signal in a stepless manner, which stepless manner change takes place in connection with controlling the energy and the delay of the audio signal on the basis of the orientation and movement information.

* * * * *